US005781099A

United States Patent [19]

Joschika et al.

[11] Patent Number: 5,781,099

[45] Date of Patent: Jul. 14, 1998

[54] TRIMMER RESISTOR

[75] Inventors: Thomas Joschika, Neumarkt, Austria; Werner Till, Grosskarolinenfeld, Germany

[73] Assignee: Wilhelm Ruf KG, Munich, Germany

[21] Appl. No.: 699,239

[22] Filed: Aug. 19, 1996

[30] Foreign Application Priority Data

Aug. 24, 1995 [DE] Germany ..... 295 13 640 U

[51] Int. Cl.[6] ..... H01C 10/32

[52] U.S. Cl. ..... 338/162; 338/211; 338/212; 338/199; 338/174

[58] Field of Search ..... 338/162, 164, 338/174, 190, 184, 199, 118, 210, 211, 212, 160; 29/617, 621

[56] References Cited

U.S. PATENT DOCUMENTS

| | | | |
|---|---|---|---|
| 3,096,499 | 7/1963 | Hudson | 338/163 |
| 3,397,374 | 8/1968 | Bang | 338/162 |
| 3,457,537 | 7/1969 | Hines | 338/162 |
| 3,531,860 | 10/1970 | Paine et al. | 29/610.1 |
| 3,576,512 | 4/1971 | Michik | 338/174 |
| 3,597,837 | 8/1971 | Mack | 29/610.1 |
| 3,657,690 | 4/1972 | Tavzes et al. | 338/154 |
| 4,210,896 | 7/1980 | Benthuysen | 338/159 |
| 4,355,293 | 10/1982 | Driscoll | 338/184 |
| 4,491,823 | 1/1985 | Bergman et al. | 338/174 |
| 4,717,903 | 1/1988 | Hinterberger | 338/162 |
| 4,839,627 | 6/1989 | Okazaki et al. | 338/174 |
| 4,928,082 | 5/1990 | Yagi et al. | 338/174 |
| 4,998,088 | 3/1991 | Masuda | 338/162 |
| 5,309,134 | 5/1994 | Ridge | 338/210 |
| 5,309,135 | 5/1994 | Langford | 338/211 |

FOREIGN PATENT DOCUMENTS

| | | | |
|---|---|---|---|
| 3013830 | 4/1980 | Germany | H01C 17/06 |
| 3500771 | 1/1985 | Germany | H01C 1/12 |
| 3609654 | 3/1986 | Germany | H01C 1/144 |
| 350071C2 | 7/1986 | Germany | H01C 10/34 |

*Primary Examiner*—Teresa J. Walberg
*Assistant Examiner*—Karl Easthom
*Attorney, Agent, or Firm*—Senniger, Powers, Leavitt & Roedel

[57] ABSTRACT

A miniature trimmer resistor has a resistor carrier with resistive path deposited thereon and solder contacts electrically connected to the resistive path. The resistor carrier and solder contacts are formed by means of a single film of electrically insulating material. This film is covered or coated with electrically conductive material in the region of the solder contacts and printed with a resistive enamel in the region of the resistive path.

14 Claims, 4 Drawing Sheets

TRIMMER RESISTOR

CROSS-REFERENCE TO FOREIGN APPLICATION

This application claims priority based on German Utility Model 295 13 640.5, filed Aug. 24, 1995, the entire disclosure of which is incorporated herein by reference.

BACKGROUND OF THE INVENTION

The invention relates generally to a trimmer resistor and, in particular, to a miniature trimmer resistor.

In general, trimmer resistors are known from DE 3,500, 771 C2. Such a known trimmer resistor possesses a housing, a resistor carrier with resistive path deposited thereon and perpendicular contacts which project from the resistor carrier and which are riveted to it in the form of contact pins. In addition, this resistor features a rotating driver for a wiper which contacts the resistive path.

A trimmer resistor of this type is used where extreme miniaturization is required, e.g., in hearing aids.

Miniaturization of the aforementioned trimmer resistor is limited by the contact pins riveted to the resistor carrier, since, on the one hand, a resistor carrier in the form of a plate must have a minimum thickness in order that an adequate holding and support function for the contact pins riveted thereto will continue to be ensured, and since, on the other hand, the rivet region must not be below a minimum size for reasons of providing a good (i.e., low) electrical transition resistance.

SUMMARY OF THE INVENTION

It is an object of this invention to further miniaturize the aforementioned trimmer resistor.

It is another object of this invention to provide such a miniaturized trimmer resistor in which its terminal pins or contacts are integrated with the resistor carrier as a single unit. Consequently, the resistor carrier need no longer assume a supporting or holding function for the contacts and can therefore be of a thinner design. In this instance, the resistor carrier comprises a film of electrically insulating material.

It is yet another object of this invention to provide such a miniaturized trimmer resistor which permits covering or coating its contacts with electrically conductive material to improve the electrical conductivity of these contacts.

It is also an object of this invention to provide such a miniaturized trimmer resistor in which the film of the resistor carrier is flexible so that the contacts may be easily bent.

Briefly described, a trimmer resistor embodying aspects of the invention comprises a housing, a resistor carrier with resistive path deposited thereon and solder contacts attached to the same, as well as a rotating driver and a wiper held on the same which electrically contacts the resistive path. The resistor carrier and the solder contacts comprise a single piece of a film of electrically insulating material and the solder contacts are covered or coated with electrically conductive material.

Other objects and features will be in part apparent and in part pointed out hereinafter.

BRIEF DESCRIPTION OF THE DRAWINGS

In the following, the invention is explained in greater detail with the aid of a preferred embodiment and in conjunction with the figures. Shown are.

Corresponding reference characters indicate corresponding parts throughout the drawings.

DETAILED DESCRIPTION OF PREFERRED EMBODIMENTS

Figure 1:
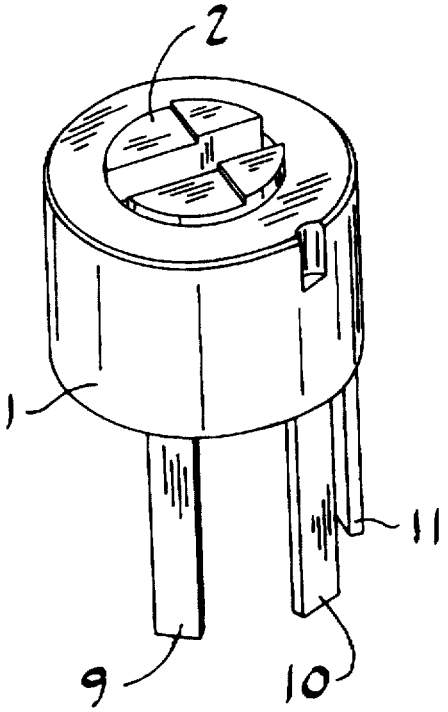
FIG. 1 is a perspective of a trimmer resistor in accordance with the invention.
Figure 2:
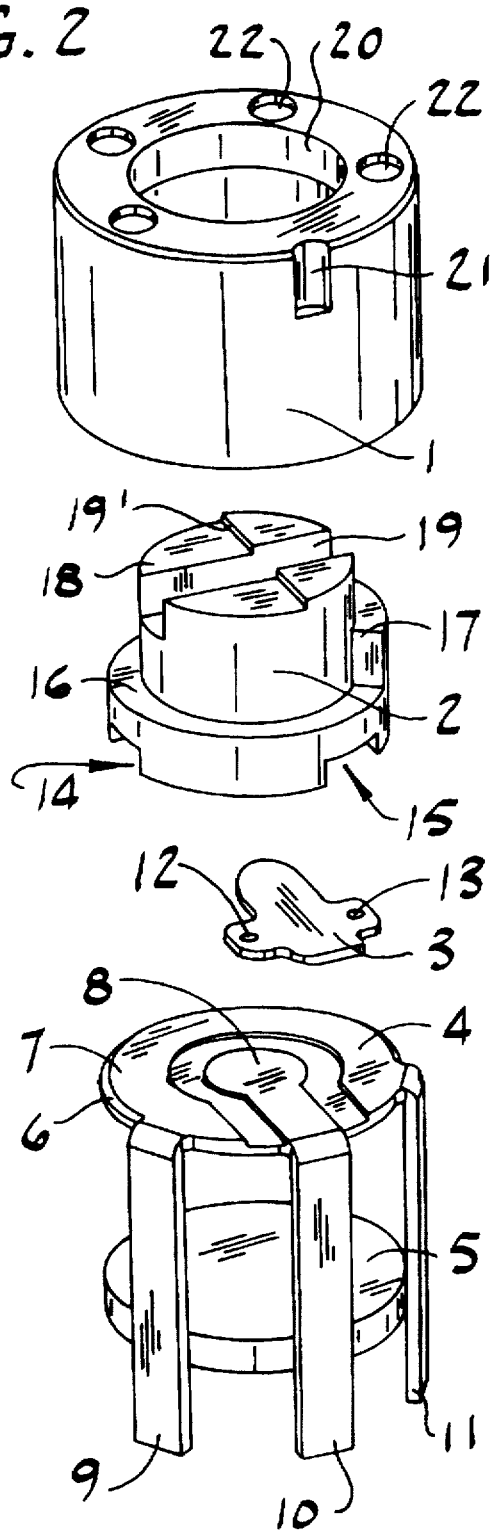
FIG. 2 is an exploded view of the trimmer resistor of FIG. 1 including a housing, a rotating driver, wiper and resistor carrier.
Figure 3A:
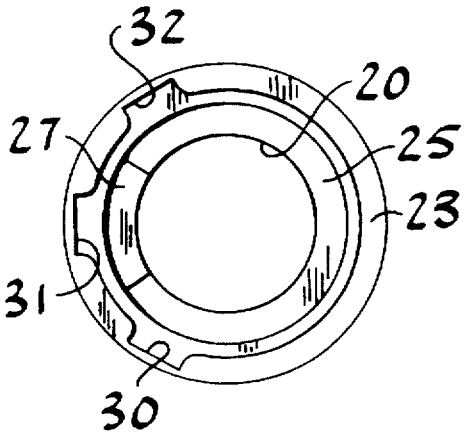
FIG. 3A is a top view of an open side of the housing of the trimmer resistor in accordance with the invention.
Figure 3C:
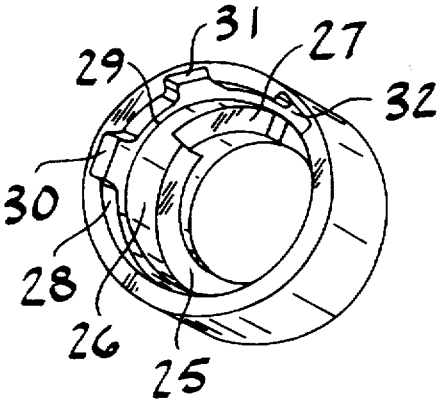
FIGS. 3C and 3D are perspectives of the open side and a control side of the housing, respectively.
Figure 3B:
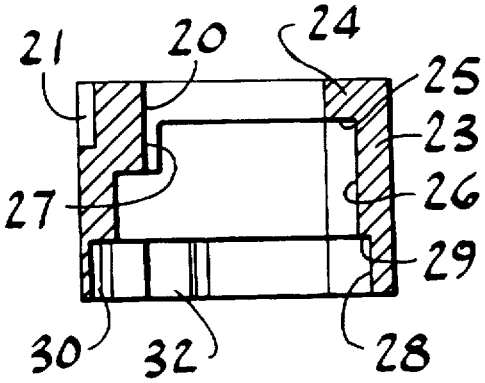
FIG. 3B is a cross section of the housing.
Figure 3D:
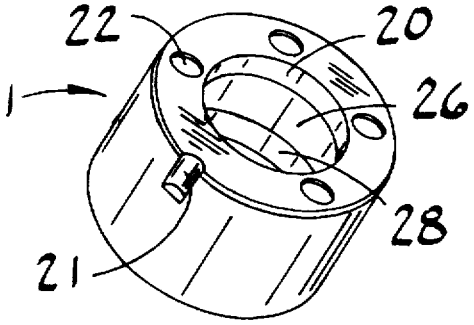

As can be best seen in FIGS. 1 and 2, a trimmer resistor according to a preferred embodiment of the invention comprises five components: a housing 1, a rotating driver 2 which can be turned therein and which contains a wiper 3 that is supported on a resistor carrier 4 and taps the resistive path and central contact of the latter. The resistor carrier 4 is also contained in the housing. A closing disk 5 holds the resistor carrier 4 in the housing 1 and closes it. The resistor carrier 4 comprises a film of electrically insulating material, such as Capton, and forms, on the one hand, a circular disk 6, on which is deposited a resistive path 7, preferably in a screen-printing process, as well as a central contact 8 of electrically conductive material, such as a copper covering and, on the other hand, forms solder contacts 9, 10, 11 connected to the disk 6 as a single piece. In this case, these solder contacts 9, 10, 11 have a long rectangular shape and are bent away from the disk 6 by approximately 90°. They are coated with electrically conductive material, for example, a copper covering and a gold layer electrodeposited thereon. The solder contacts 9, 10, 11 are displaced with respect to each other in relation to the disk 6 by an angle of, for example, 60°, with the solder contacts 9, 11 being electrically connected to the two ends of the resistive path 7 and the solder contact 10 being electrically connected to the central contact 8. The coating or copper covering of the solder contacts 9, 11 therefore extends all the way to the surface of the disk 6, with the resistive path 7 having the shape of an open circular ring, the ends of which cover the coating of the solder contacts 9, 11 located on the disk 6. The coating of electrically conductive material of the central contact 8 passes directly over to the covering of the solder contact 10. In this instance, either solder contact 9 or solder contact 11 constitute a first electrical lead and central contact 8 constitutes a second electrical lead.

The wiper 3 preferably has the form of a cross with four legs, as shown in a top view (see FIG. 5A), with dome-shaped sliding first and second contacts 12, 13 projecting from two legs forming a line. Of these two sliding contacts, the sliding contact 12 represents the central tap of the trimmer resistor which is in contact with the central contact 8, while the sliding contact 13 represents the wiper tap which is in contact with the resistive path 7.

The wiper 3 comprises a spring-like elastic, electrically conductive material, such as copper, steel or an alloy of a contact material, with the legs which do not carry a wiper contact being bent upwards and consequently generating a pressure or force. The wiper 3 is held in recesses 14, 15 of the rotating driver and turns with the rotating driver 2. In this instance, wiper 3 constitutes an electrically conductive moveable member.

The rotating driver 2 has a substantially cylindrical shape with a projecting collar 16 on its end facing the resistor carrier 4. Preferably, the side of the collar 16 which faces away from the resistor carrier 4 serves as an axial limit stop with respect to the housing 1. A radial projecting rotating limit stop 17, which works in conjunction with counter-limit stops in the housing 1, is placed on this collar 16. A cylindrical rotating body 18 with a slot 19 for adjustment by means of a screwdriver is present over the projecting collar. This cylindrical rotating body 18 juts through an opening 20 of the housing 1, as is best shown in FIG. 1. The end of the cylindrical rotating body 18 has a step 19' transverse to the slot 19 which is arranged to be staggered with respect to the turning axis of the rotating body. By means of the slot 19 and step 19', the end of the rotating body takes on the approximate appearance of an arrow, by means of which the turning position of the rotating body can be read unequivocally, which facilitates adjustment of the trimmer resistor, in particular, in conjunction with the markings 22 described in the following paragraph. A reading of the turning position by means of only a slot 19 would be ambiguous, since positions rotated 180° could not be differentiated.

The outer periphery of the housing 1 has a marking 21 which, in this case, has the shape of a notch or impression and serves to indicate the fitting position of a trimmer resistor. Additional markings 22 are provided on the upper side of the housing, around the recess 20, which in this case, have the shape of circular impressions and serve to indicate the kind of trimmer resistor, its amount of resistance or the like. For this purpose, the impressions can be paint-filled in accordance with a color code. In conjunction with the arrow-shaped appearance of the end of the rotating body 18, these markings 22 allow the turning position and, with this, the adjusted value of a trimmer resistor to be read, which results in a double function of the markings 22.

In the embodiment represented, the solder contacts 9, 10, 11 are bent away from the disk 6 and, with this, jut out of the housing 1 and have a path parallel to the turning axis of the trimmer resistor. Of course, it is also possible to leave the solder contacts 9, 10, 11 in the plane of the disk 6, by which a trimmer resistor is obtained which can be used in SMD-technology (surface-mount devices).

FIG. 3 shows different views of the housing 1. In principle, the housing 1 has the form of a cylindrical cup, in the base of which is an opening 20. In order to clarify the scope of miniaturization, it is pointed out that for a concrete example the outer diameter of the housing is 1.9 mm. An opening 20, inwardly displaced with respect to the cylindrical case 23 of the housing, forms a radially inwardly protecting collar 24, the inward facing surface 25 of which forms an axial limit stop which works in conjunction with the collar 16 of the rotating driver. From the inner wall 26 of the case 23, a turning limit stop 27 starting from the surface 25 projects into the interior of the housing and serves as a counter-limit stop for the rotating limit stop 17 of the rotating driver. In the present example, this rotating limit stop 27 covers an angular range of approximately 64°.

On the open side of the housing is a radial enlargement 28, which forms a shoulder 29 with the inner wall of the housing. This shoulder supports the closing disk 5 (FIG. 2). The outer diameter of the closing disk 5 corresponds to the inner diameter of the enlargement 28.

Axial indentations 30, 31, 32 are provided in this enlargement 28 and form open spaces between the closing disk 5 and case 23 of the housing 1 to allow passage of the solder contacts 9, 10, 11. The depth of these recesses 30, 31, 32 corresponds to the thickness of the coated solder legs 9, 10, 11 such that together with the closing disk 5, the housing is scaled to the greatest extent possible.

Figure 4B:
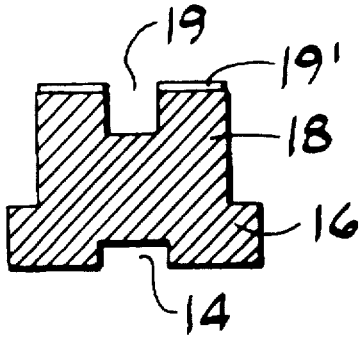
FIGS. 4B–4E are different views of the rotating driver, in partial section.
Figure 4A:
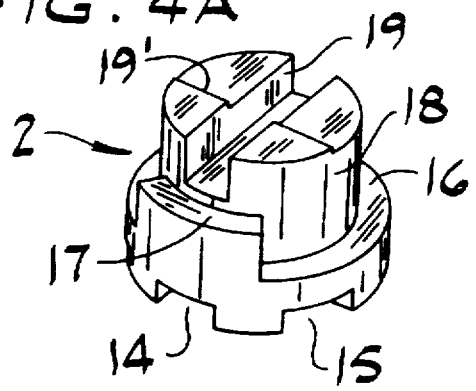
FIG. 4A is a perspective of the rotating driver of the trimmer resistor in accordance with the invention.
Figure 4C:
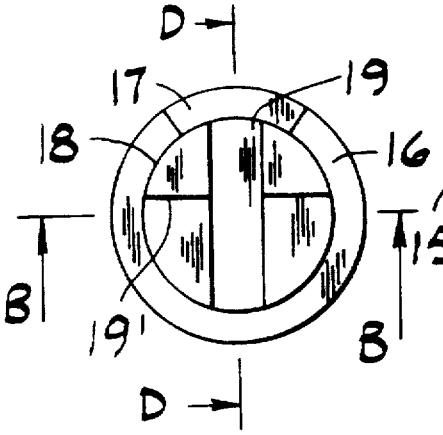
Figure 4D:
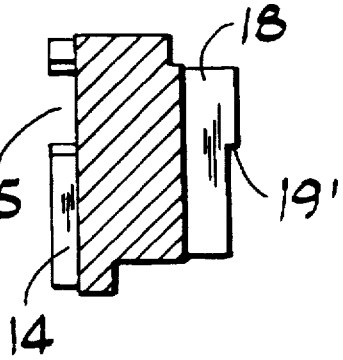
Figure 4E:
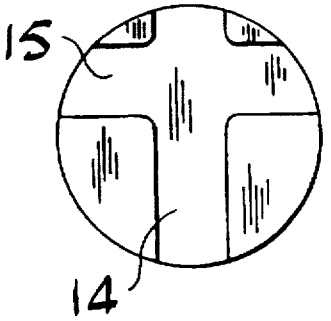

FIGS. 4A–4E show different views of a rotating driver 2, with FIG. 4A showing a perspective view similar to FIG. 2; FIG. 4B showing a section along line B—B of FIG. 4C; FIG. 4C showing a top view of the upper side; FIG. 4D showing a section along line D—D of FIG. 4C; and FIG. 4E showing a view of the underside facing the resistor carrier. The fundamental elements of the rotating driver were already described in conjunction with FIG. 2, such that their repetition here is unnecessary; reference numerals identical to those in FIG. 2 indicate identical parts. With reference to FIG. 4E, only the recesses 14, 15 for the holding and rotating driving of the wiper are explained. These recesses intersect generally at a right angle, with the recess 14 being located symmetrically to an axis perpendicular to the turning axis of the rotating driver and intersecting the same. The recess 15, in contrast, is located asymmetrically to the turning axis, by which means one of the two contacts 12 or 13 can be located precisely in the turning axis.

Figure 5A:
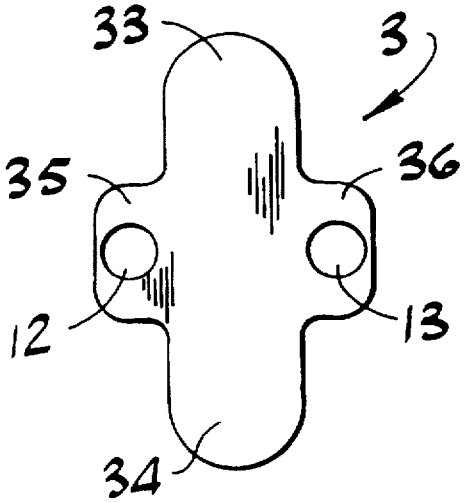
FIG. 5A is a top view of the wiper of the trimmer resistor in accordance with the invention.
Figure 5B:
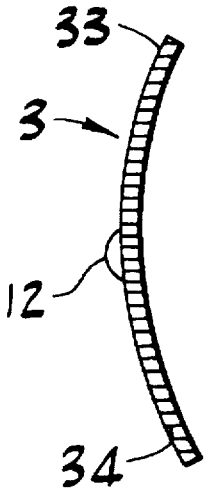
FIG. 5B is a view in section of the wiper.

A wiper in accordance with FIG. 5A has the form of a cross with two pairs of legs 33, 34 and 35, 36, with the contacts 12, 13 being attached to one of the legs 35, 36, respectively. The legs of each pair merge, with the legs 33, 34 being bent upward (see FIG. 5B). These legs 33, 34 are located in the recess 15 of the rotating driver (FIG. 4E), while the legs 35, 36 are located in the recess 14. Thus, one of the contacts 12 or 13 is aligned with the turning axis of the rotating driver 2, and the legs 33, 34 that are bent upward and that are supported by the base of the recess 15 press the legs 35, 36 which project somewhat from the base of the recess 14, and their contacts 12, 13 against the resistor carrier or, more precisely, against the resistive path 7 or central contact 8. Thus, no springs are required to press down the wiper.

Figure 6:
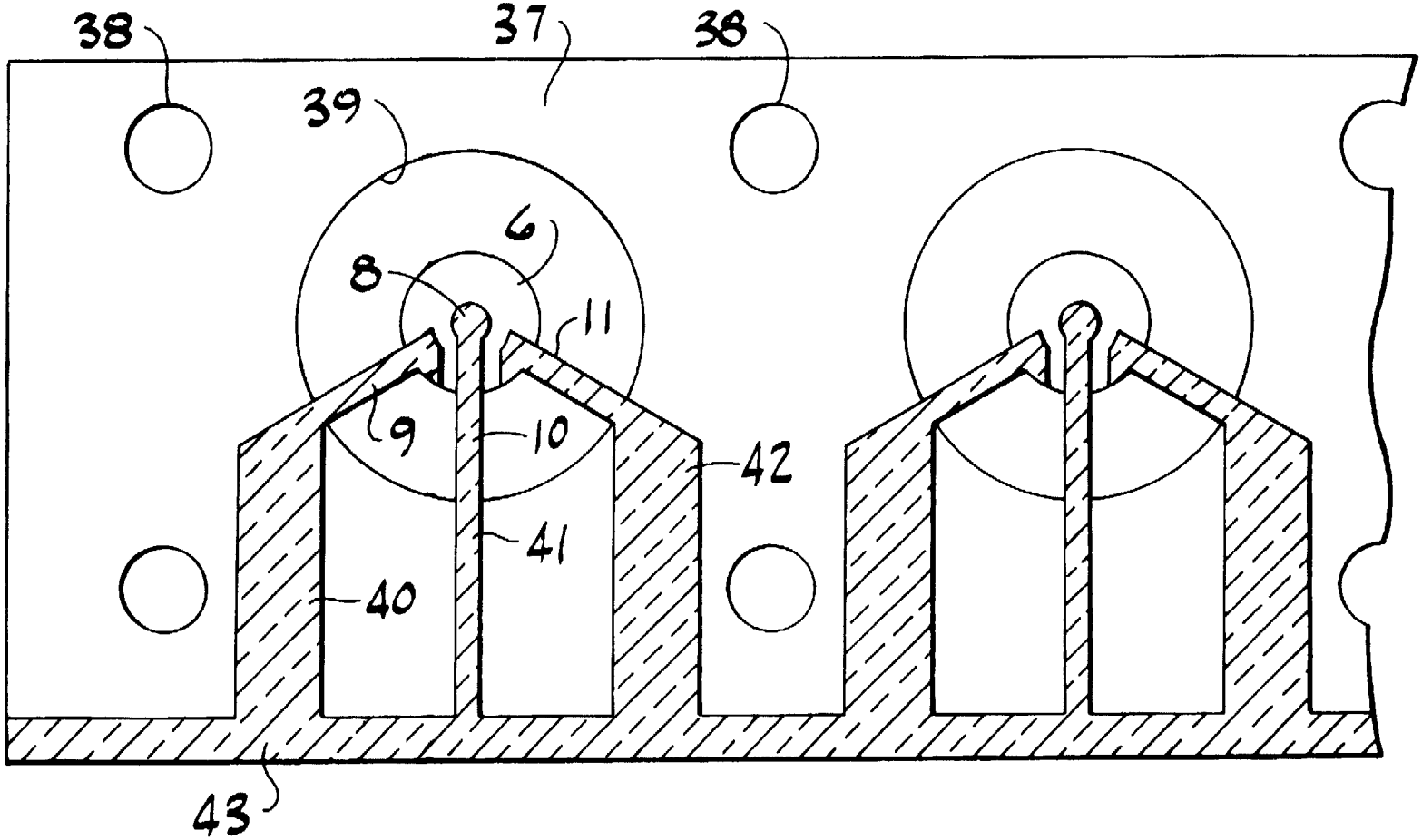
FIG. 6 is a top view of a film strip from which the resistor carrier of the trimmer resistor with integrated contacts is manufactured in accordance with the invention.

FIG. 6 shows a film strip 37 of an electrically insulating material, from which resistor carriers are fabricated. This film strip 37 has a several feed holes 38, which are staggered with respect to each other in a grid. At the same time, the disk 6 is located congruent to these in circular recesses 39, which disk is held to the film strip 37 by means of three tabs which later form the solder contacts 9, 10, 11. These "tabs" 9, 10, 11 are covered or coated with an electrically conductive material, which is indicated by means of hatching. This coating is continued in strips 40, 41, 42 which have a path perpendicular to the longitudinal axis of the film strip 37 and open into a strip 43 which has a path parallel to the longitudinal axis of the film strip 37 and which is likewise coated without interruption with electrically conductive material, such that all strips 9, 10, 11, 40, 41, 42 are electrically connected to the strip 43.

The pattern of strips represented in FIG. 6 by means of hatching is manufactured, for example, such that a plastic strip initially covered with copper over its entire surface is formed by means of conventional techniques for the manufacture of electrical strip conductors, e.g., conventional exposure and etching. All of the remaining copper covering can be subsequently electroplated with an additional electrically conductive material, such as gold. A film strip 37 prepared in this way is subsequently further processed by means of a transport device in conjunction with the feed holes 38 in a punching device, where the strips 9, 10, 11 of each resistor carrier are punched at the border of the respective opening 39. Also, the solder contacts 9, 10, 11 can be bent away from the plane of the disk 6 simultaneously with this punching process. Thus, some of the fabrication can be carried out completely automatically, with additional assembly steps also capable of being automated.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

What is claimed is:

1. A trimmer resistor comprising:

a housing, wherein the housing is substantially cylindrical, including a enlargement, a rotating driver and a wiper held on the same which both can be turned in the housing around a turning axis, a flexible film of electrically insulating material comprising a resistor carrier, wherein the film of the resistor carrier comprises a substantially circular disk which is positioned perpendicular to the turning axis and has a resistive path deposited thereon and oblong solder contacts attached to the same, wherein the wiper electrically contacts the resistive path, and a closing disk which is contained in the enlargement for closing the housing, wherein the solder contacts are a single piece of the film of electrically insulting material bent away by approximately 90° from a plane of the circular disk of the resistor carrier and coated with electrically conductive material, and wherein the enlargement of the housing includes recesses which extend generally parallel to the turning axis and pass the closing disk, wherein sections of the solder contacts are accommodated in the recesses and partly arranged between the closing disk and the housing and project generally parallel to the turning axis within said recesses and out of the housing.

2. The trimmer resistor of claim 1 wherein the coating of the solder contacts extends to the circular disk of the resistor carrier in order to form a central tap contact and in order to join the solder contacts to the resistive path deposited on the circular disk.

3. The trimmer resistor of claim 1 wherein the electrically conductive material of the solder contacts comprises a copper covering over the resistor carrier and a gold layer deposited thereon.

4. The trimmer resistor of claim 1 wherein the enlargement has a diameter which corresponds to the diameter of the disk, said enlargement forming a shoulder which serves as a limit stop in order to position the disk in the interior of the housing.

5. An apparatus comprising:

a flexible film of electrically insulating material;

a generally planar resistive path formed on the insulating film;

a first electrical lead connected to the resistive path and formed on a portion of the insulating film;

a second electrical lead separated from the resistive path and the first lead and formed on another portion of the insulating film, said first and second leads being bent approximately 90° relative to a plane of the resistive path;

a substantially cylindrical housing for housing the insulating film, said housing having an inside surface including recesses which receive the portions of the insulating film on which the first and second leads are formed, said recesses extending in a direction generally parallel to an axis defined by the cylindrical housing said leads received in said recesses and extending therein in a direction generally parallel to the axis; and a rotating driver in an engaging relationship with the moveable member for moving the moveable member along the resistive path whereby the resistance between the second contact of the moveable member and the first lead is adjustable by rotating the rotating driver.

6. The apparatus of claim 5 wherein the insulating film comprises a single piece of integral, continuous material and wherein the second contact of the moveable member is in contact with the second lead so that the resistive path is connected in series between the first and second leads.

7. The apparatus of claim 5 wherein the first and second leads each comprise a coating of electrically conductive material on the respective portion of the insulating film.

8. The apparatus of claim 7 wherein the conductive material of the first and second leads comprises a copper coating on the insulating film and a gold layer deposited thereon.

9. The apparatus of claim 7 wherein the insulating film comprises a disk-shaped portion and the resistive path comprises an electrically resistive material deposited on the disk-shaped portion of the insulating film and wherein the resistive path is generally arcuate.

10. The apparatus of claim 9 wherein the housing has an inside diameter greater than the diameter of the disk-shaped portion of the insulating film and has an inner shoulder wherein the housing receives the disk-shaped portion of the insulating film and the disk-shaped portion of the insulating film is positioned in the housing adjacent the inner shoulder.

11. The apparatus of claim 10 wherein the portions of the insulating film on which the first and second leads are formed extend from the disk-shaped portion of the insulating film on which the resistive path is formed and wherein the recesses in the housing receive the portions of the insulating film on which the first and second leads are formed when the disk-shaped portion of the insulating film is positioned in the housing.

12. The apparatus of claim 10 further comprising a closing disk, the diameter of which corresponds to the inside diameter of the housing, seated in the housing adjacent the disk-shaped portion of the insulating material positioned inside the housing thereby to close the housing.

13. The apparatus of claim 12 wherein the first and second leads project from the housing when the housing is closed by the closing disk.

14. A method of manufacturing an adjustable resistance trimmer resistor, said trimmer resistor having first and second electrical leads and a rotating driver, the resistance of the trimmer resistor being adjustable by rotating the rotating driver, said method comprising the steps of:

depositing an electrically resistive material on a first portion of a flexible film of electrically insulating material thereby to form a generally planar resistive path;

covering a second portion of the insulating film adjacent the resistive path with an electrically conductive material thereby to form the first lead connected to the resistive path;

covering a third portion of the insulating film separated from the resistive path and the first lead with the conductive material thereby to form the second lead;

positioning an electrically conductive moveable member having first and second electrical contacts in an engaging relationship with the rotating driver and so that the first contact is in contact with and moveable along the resistive path and the second contact is in contact with the second lead whereby the resistance between the first and second leads is adjustable by rotating the rotating driver to move the moveable member;

bending the second and third portions of the insulating film approximately 90° relative to a plane of the resistive path; positioning the insulating film in a substantially cylindrical housing, said housing having an inside surface; and forming recesses in the inside surface of the housing which receive the second and third portions of the insulating film on which the first and second leads, respectively, are formed, said recesses extending in a direction generally parallel to an axis defined by the cylindrical housing, said leads received in said recesses and extending therein in a direction generally parallel to the axis.

* * * * *

UNITED STATES PATENT AND TRADEMARK OFFICE

CERTIFICATE OF CORRECTION

PATENT NO. : 5,781,099

DATED : July 14, 1998

INVENTOR(S) : Thomas Joschika et al.

It is certified that error appears in the above-identified patent and that said Letters Patent is hereby corrected as shown below:

Column 6, claim 5, lines 7-8, "path; a substantially" should read:

---path;

an electrically conductive moveable member having first and second electrical contacts, said first contact of the moveable member being in contact with and moveable along the resistive path;

a substantially---.

Signed and Sealed this

Twenty-sixth Day of September, 2000

*Attest:*

Q. TODD DICKINSON

*Attesting Officer*

*Director of Patents and Trademarks*